US005269423A

United States Patent [19]

Nguyen

[11] Patent Number: 5,269,423

[45] Date of Patent: Dec. 14, 1993

[54] BAG DISPENSER SYSTEM

[75] Inventor: Tai Nguyen, Kenner, La.

[73] Assignee: Advance PolyBag, Inc., Metairie, La.

[21] Appl. No.: 927,073

[22] Filed: Aug. 7, 1992

Related U.S. Application Data

[63] Continuation-in-part of Ser. No. 851,813, Mar. 16, 1992.

[51] Int. Cl.[5] ..... B65D 85/62

[52] U.S. Cl. ..... 206/554; 206/494; 221/26; 221/45; 221/55; 221/63

[58] Field of Search ..... 206/494, 495, 554; 221/26, 33, 45, 46, 48, 55, 63

[56] References Cited

U.S. PATENT DOCUMENTS

| | | | |
|---|---|---|---|
| 633,726 | 12/1900 | Carlen | 206/554 |
| 1,190,661 | 7/1916 | Marker | 221/26 |
| 2,299,940 | 10/1942 | Thomasma | 221/26 |
| 2,925,175 | 2/1960 | Williamson et al. | 206/554 |
| 3,090,522 | 5/1963 | Hohwart | 221/33 |
| 3,738,482 | 6/1973 | Cwikla | 206/554 |
| 3,777,439 | 12/1973 | Fried | 206/554 |
| 3,896,966 | 7/1975 | Canno | 206/554 |
| 4,044,919 | 8/1977 | Olson | 221/63 |
| 4,046,281 | 9/1977 | Voegeli | 221/48 |
| 4,265,366 | 5/1981 | Schillinger et al. | 206/494 |
| 4,363,405 | 12/1982 | Christie | 206/554 |
| 4,453,649 | 6/1984 | Origuchi | 206/554 |
| 4,506,801 | 3/1985 | Origuchi | 206/554 |
| 4,527,693 | 7/1985 | Membrino | 206/554 |
| 4,805,800 | 2/1989 | Nocek et al. | 206/554 |
| 4,805,969 | 2/1989 | Heacock | 206/554 |

FOREIGN PATENT DOCUMENTS

| | | | |
|---|---|---|---|
| 735736 | 6/1966 | Canada | 221/33 |

*Primary Examiner*—David T. Fidei

*Attorney, Agent, or Firm*—Joseph T. Regard, Ltd.

[57] ABSTRACT

An apparatus for dispensing large thermoplastic bags utilizing a relatively compact dispensing container. The preferred embodiment of the present invention as implemented teaches a system for dispensing bags, wherein the container is configured to dispense a laterally folded bag stack, reducing the length of the container. The present invention provides a compact, manageable, and more convenient system for dispensing compact bags and the like, resulting in overall cost and time savings. The container of the present invention has formed therein a removable dispenser door, configured for providing convenient access to the bags, while encouraging communication of the bag being dispensed with the container in such a matter as to open the bag during the dispensing operation.

1 Claim, 3 Drawing Sheets

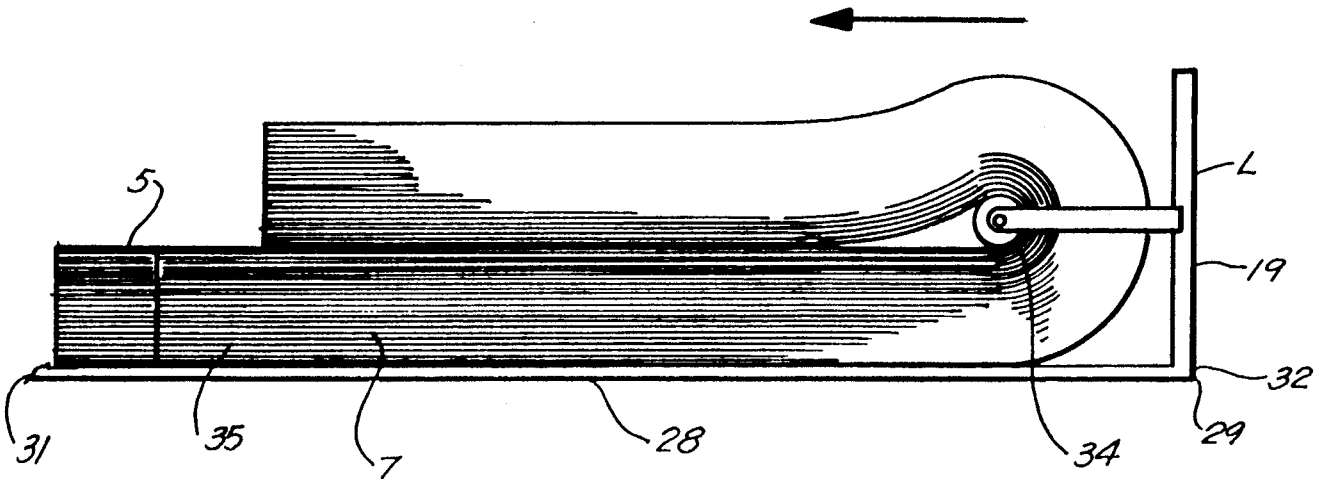
FIG. 4
FIG. 5
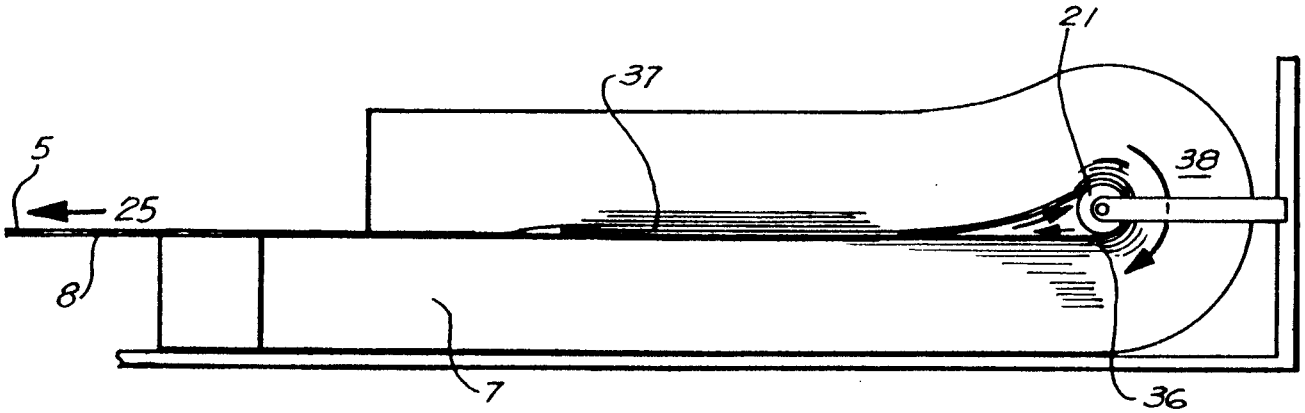

BAG DISPENSER SYSTEM

STATEMENT OF CONTINUING APPLICATION

The present invention is a continuation-in-part of U.S. patent application Ser. No. 07/851,813 filed Mar. 16, 1992, entitled "Bag Stack Dispenser System", indicating as inventor Tai Nguyen.

FIELD OF INVENTION

The present invention relates to bag dispensing systems, and in particular to a method and apparatus for dispensing large thermoplastic bags or the like utilizing a relatively compact dispensing container.

The preferred embodiment of the present invention as implemented teaches a system for dispensing bags or the like, wherein the container is configured to dispense a laterally folded bag stack, reducing the length of the container.

The present invention provides a compact, manageable, and more convenient system for dispensing thermoplastic bags and the like, resulting in overall cost and time savings.

The container of the present invention has formed therein a removable dispenser door, configured for providing convenient access to the bags, while encouraging communication of the bag being dispensed with the container in such a matter as to open the bag during the dispensing operation.

PRIOR ART & GENERAL BACKGROUND

While the prior art has contemplated a variety of thermoplastic bag dispenser systems, none apparently have contemplated a system wherein the container is configured to dispense a laterally folded bag individually from a bag stack, thereby allowing the dispensing a bag of greater length than the dispensing container.

The dimensions of a bag dispenser stack are of important significance, in that it influences the overall efficiency of the system with regard to storage and handling. A compact bag dispenser stack is desirable, as it allows for more efficient storage and easier handling by the end user, which often may comprise "check out girls" and the like who may not have the size or strength to handle larger bag stacks.

A list of prior patents which may be of interest is presented below:

| Patent No. | Patentee(s) | Issue Date |
|---|---|---|
| 3,640,450 | Lieberman | 02/1972 |
| 4,476,979 | Reimann et al | 10/1984 |
| 4,493,419 | Prader et al | 01/1985 |
| 4,595,389 | Lehmacher | 06/1986 |
| 4,613,988 | Maddock | 09/1986 |
| 4,759,639 | DeMatteis | 07/1988 |

Further, the prior art fails to contemplate a bag dispenser system configured for dispensing bags in an individual, open capacity, that system utilizing friction means for communicating with the second, lower wall of the bag, while the upper, first wall of the bag is being removed in longitudinal fashion from the bag stack and container.

Use of the container in a dispensing capacity for thermoplastic bags is not entirely new. For example, Cupples ® of La Mirada, Calif. sells a thermoplastic bag dispensing system wherein the container is utilized for dispensing the bags. However, the Cupples ® and other known like systems do not contemplate the lateral folding dispenser system of the present invention.

U.S. Pat. No. 4,759,639 issued 1988 to DeMatteis teaches what is believed to be the some of the technology utilized in the Cupples ® dispensing system. Unlike the present invention, the '639 system requires the tearing off of tabs on the bags during the release process, which may weaken the bag structure by causing stress fractures, causing failure of the bag. Further, the prior art has yet to contemplate the lateral folding structure of the present system, wherein there is provided a more compact and less elongated dispensing container.

In addition, all of the above disclosed patents teach dispensing systems which include in some degree tabs or perforated areas in their respective bag stacks, for dispensing of each bag, increasing the possibility of failure for these systems.

As thermoplastic bags tend to rupture with the slightest cut, it is suggested that the optimal bag dispensing system dispense with the requirement of release tabs and perforations, thereby avoiding the possibility of defect. While the prior art fails in this regard, the present invention provides a cost effective, environmentally sound, and safe system for dispensing bags, wherein the bags are conveniently dispensed whole and without tabs or perforations, decreasing the probability of rupture, as well as excess waste plastic, in the form of unused tab material.

Further, unlike the prior art, the present invention teaches a compact, efficient, more easily handled dispenser container, while allowing for the relatively easy, individual dispensing of larger bags from smaller bag stack dispensing containers.

GENERAL, SUMMARY DISCUSSION OF THE INVENTION

The present invention overcomes the prior art problems discussed supra, by providing a system which is highly reliable and simple to operate, environmentally sound, and relatively cost effective.

The present invention provides a system for dispensing a bag stack, wherein there is utilized the shipping container itself as the dispensing apparatus, thereby providing a more efficient use of resources. Unlike the prior art, the present invention utilizes an unique, frictional template dispensing mechanism which is inexpensive to manufacture and easily recycled, and further provides a means of folding the bag stack in lateral fashion in the container in such a manner as to allow the individual dispensing of the bags from the folded stack from the container. This allows for a more compact dispenser container configuration, resulting in more efficient storage and use of resources in dispensing the bags by the end user.

The present invention contemplates the dispensing of laterally folded thermoplastic bags from a bag stack on an individual basis, the dispensed bag provided in an open position for loading. The method of dispensing bags as taught in the present invention is itself new and unique, with the user grasping the handle of the upper wall of the bag to be dispensed, directing the bag in a longitudinal fashion through a bag dispensing area, wherein the second, lower wall of the bag communicates frictionally between two template members, urging the bag's mouth to form into an open position by the time the bag is dispensed. Further, the folded, dispensed bag is guided via dispenser bar or roller, to allow for the unfolding of the bag during its dispensing resulting in the full unfolding of the bag during the dispensing process.

The present system provides a longitudinal means for dispensing the bags from the container, allowing the container to be placed in a relatively out of the way fashion, leaving the bag loading area unencumbered.

It is therefore an object of the present invention to provide a bag dispensing system wherein the container is utilized in a dispensing capacity.

It is another object of the present invention to provide a bag dispensing system wherein there is provided a frictional means for urging the dispensed bag into an open position upon dispensing.

It is still another object of the present invention to provide a bag dispensing system comprising a stack of bags situated about a container and template system, wherein the stack is folded in lateral fashion about midway along the length of the bag stack, and wherein each bag is individually dispensed in longitudinal fashion through a dispensing port out of one end of the container.

It is yet another object of the present invention to provide a bag dispensing system which does not require the utilization of tabs, perforations or the like.

It is another object of the present system to provide a bag dispensing system wherein the dispensing container is relatively compact, efficiently stored and easily handled.

Lastly, it is an object of the present invention to provide a bag dispensing system which may be utilized with a variety of configured thermoplastic bags, and wherein the bag dispensed may be of greater length than the dispensing container.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 4 is a side view of the invention of FIG. 1, illustrating the base member and its communication with the roller bar assembly, further illustrating the configuration and placement of the bag stack in laterally folded arrangement about the roller bar.

FIG. 5 is a side view of the invention of FIG. 1, illustrating the dispensing of the bag from the folded bag stack via the longitudinal drawing of the dispensed bag, releasing said bag from the stack, and allowing it to be drawn about said bar and from said container/dispenser.

DETAILED DESCRIPTION OF THE INVENTION

Figure 1:
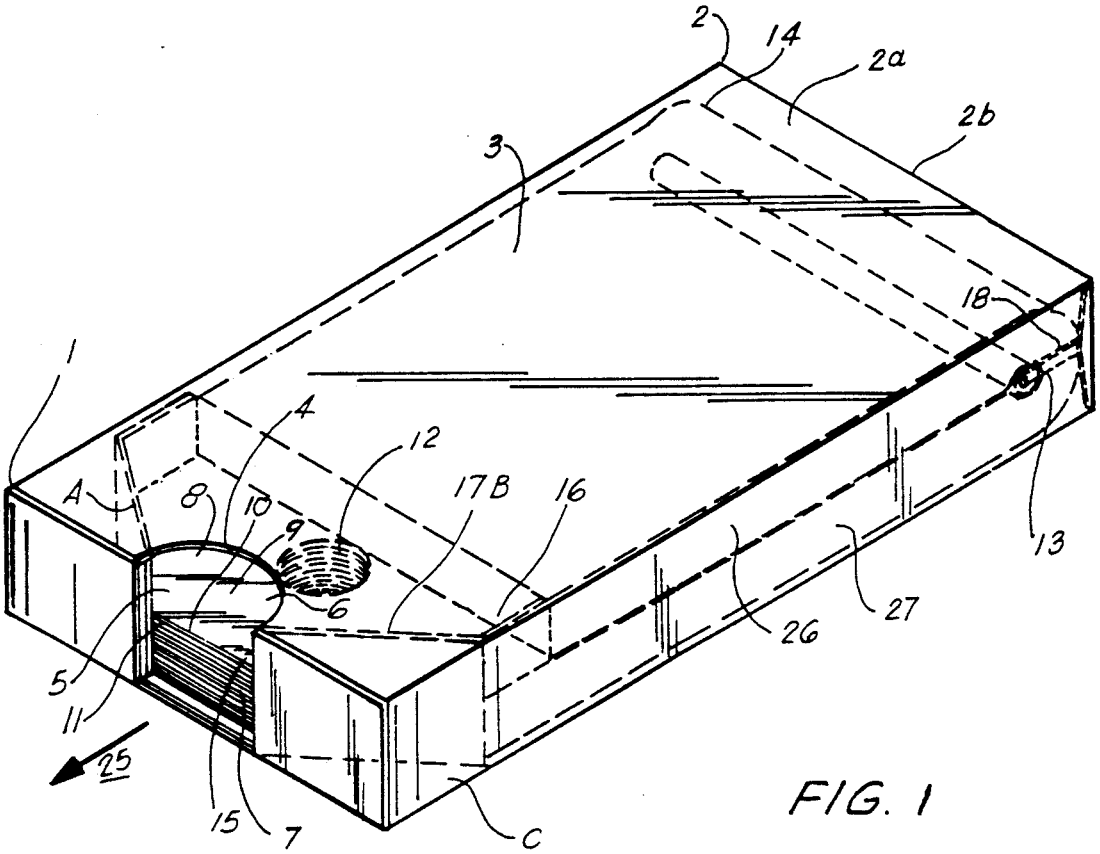
FIG. 1 is an isometric view of the preferred embodiment of the bag stack dispenser system of the present invention, illustrating the bag stack laterally folded about a roller bar arrangement, the container, dispenser door, template/spacer arrangement, and the positional relationship between the various components.

As shown in FIG. 1, the present invention includes a container C having first 1 and second 2 ends, said second end further having inner 2*a* and outer 2*b* sides, the container further having a top 3 side, wherein there is further provided a perforation 4 across the top 3 side, the perforation having a bag grasping area 5 configured to have a portion removable by the user, forming a bag dispensing area 6.

Accommodated by container C is bag stack 7, comprising a plurality of stacked, individual bags 8, the preferred embodiment of which includes first 15 and second 16 ends, the first end including an elevated handle area 9 and a handle aperture 12, the bag further including first 10 and second 11 walls.

Also provided in container C are templates 17A, 17B, each having first and second ends and first and second sides. Templates 17A, 17B are situated between the first end 1 wall of container C and the bag stack 7, the first side of templates 17A, 17B communicating with the first end 1 wall of container C, and the second side communicating with the first end 15 of bag stack, and are configured to provide the bag dispensing area 6 therebetween.

Templates 17A, 17B are constructed such that their bag engaging sides are comprised of a material which frictionally or otherwise engages the first end 15 of bag stack in a releasable fashion. The templates may be configured of block styrofoam, or may be formed of folded cardboard or like material emanating from container C.

As shown in FIG. 4, the present invention may also include a base member 28, formed of cardboard or the like, communicating between the lower portion of the bag stack and the bottom floor of the container. Base member 28 includes first 31 and second 32 ends, corresponding in spacial relationship with the first (1) and second (2) ends of container.

Emanating from the second end 32 of base member 28 is the lateral dispensing system L, which includes extension member 19, configured to communicate with the inner side wall (2*a*) of container.

Figure 2:
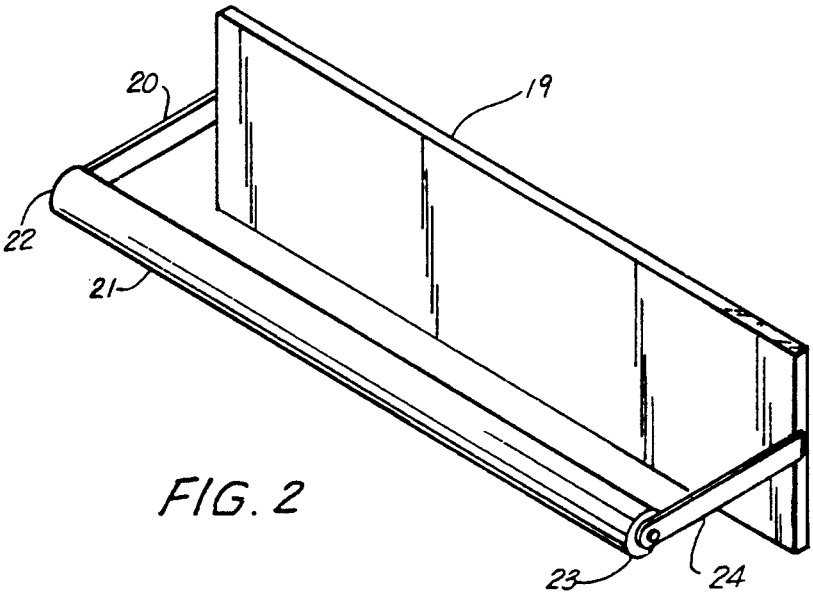
FIG. 2 is an isometric view of the invention of FIG. 1, illustrating the roller bar arrangement, further illustrating the base, lateral support bars, and roller bar.

As shown in FIG. 2, laterally emanating at opposing ends of member 19 are lateral support bars 20, 24, each having affixed 22, 23 at their respective distal ends dispenser bar 21. In the preferred embodiment of the present invention, dispenser bar 21 may be rotatingly affixed about lateral support bars 20, 24, but it is noted that a rotating arrangement is not particularly necessary for the system to perform in a satisfactory manner.

Figure 3:
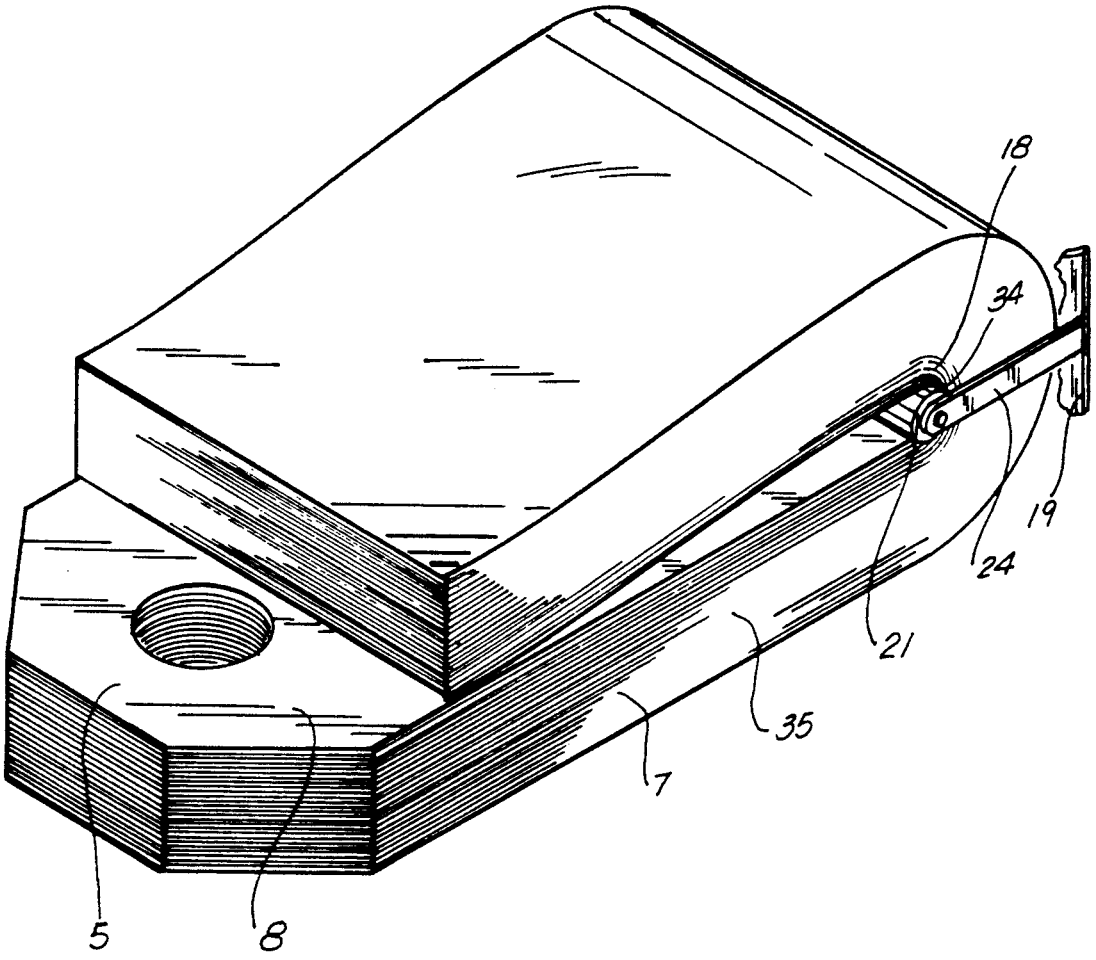
FIG. 3 is an isometric view of the invention of FIG. 1, illustrating the bag stack laterally folded about the roller bar arrangement at about its midsection area.

Returning to FIGS. 3 and 4, the bag stack 7 is configured such that it is folded over at generally about its lower medial area 34 so as to somewhat envelope dispenser bar 21. Further, the bag stack is folded such that the bottom portion 35 has the handle grasping portion 5 of the stack 7 exposed for dispensing the exposed bag 8 on an individual basis.

Referring to FIG. 1 of the drawings, in use, the user removes that portion of the upper, top side 3 and end side of container C as allowed via perforation 4, exposing the bag dispensing area 6. The user then merely places his finger(s) upon the elevated handle area 9 of the first wall 10 of bag 8, applying downward pressure, while pulling the first wall 10 in a longitudinal 25 fashion toward him relative the container C.

In doing so, referring to FIG. 5, the medial 36 and lower 37 area of the bag 8 is rotatingly 38 drawn about dispenser bar 21, while the handle area 5 of bag 8 is longitudinally 25 drawn from the bag stack 7, until the bag 8 is fully released from the stack 7 and dispensed from the container. Note that the rest of the bag stack 7 remains unaffected, with the next bag on the stack ready to be dispensed after the dispensed bag is fully removed.

| Exemplary Measurements | |
|---|---|
| Description | Measurements |
| Container | 6" height × 12" wide × 24" deep |
| Dispenser Port | 6" height × 5" wide (at box end)<br>5" wide × 4" deep (on top side) |
| Bag | 11.75" wide × 36" deep |
| Height of Bag Stack | 5.50" height |
| Template | 5.75" Height × 4" wide × 3" deep |
| Dispenser Bar | 11.90" |
| Base Member | 12" × 24" |
| Base Extension | 12" × 6" |

| Exemplary Materials | |
|---|---|
| Description | Material |
| Container | Cardboard |
| Bag | Polyurethane |
| Template | Cardboard |
| Lateral Support Bars | 11 gauge steel wire |
| Dispenser Bar | Polyurethane tube over 11 guage steel wire or may comprise bare wire. |

The embodiments described herein in detail for exemplary purposes are of course subject to many different variations in structure, design, application and methodology. Because many varying and different embodiments may be made within the scope of the inventive concepts herein taught, and because many modifications may be made in the embodiments herein detailed in accordance with the descriptive requirements of the low, it is to be understood that the details herein are to be interpreted as illustrative and not in a limiting sense.

What is claimed is:

1. A bag stack dispenser system, comprising:

a container (C) having first (1) and second (2), generally lateral end walls, forming opposite ends of said container, said container further comprising a top wall (3) juxtaposed to, and perpendicularly situated between, said first (1) and second (2) end walls, said top wall forming the top surface of said container, said container further comprising first and second, opposing edge walls situated between said first and second end walls, respectively, said first and second edge walls forming said first and second opposing edges of said container, respectively, said container further having a dispenser port (6) formed in said first end wall, said dispenser port (6) further formed in a portion of said top side (3) near said first end wall;

a dispenser bar (21) situated juxtaposed and generally perpendicular to said first and second edge walls of said container, wherein said dispenser bar (21) is supported by first and second support members affixed to the first and second ends of said dispenser bar (21), respectively, said first and second support members emanating from a base in contact with the inner (21) side wall of said second end wall of said container;

a stack (27) formed of a plurality of bags, each of said bags having a first end (15), a second end (16), and a medial area (14) therebetween, and a grasping area (5) generally near the first end of each of said bags, said stack folded at about said medial area about said dispenser bar, so as to effect contact of said dispenser bar with an upper surface of the topmost bag of said stack (27), said folded stack forming a bottom portion (27) and an upper portion (26), so as to reveal a portion of an upper surface of the topmost bag of said stack (27) such that said grasping area (5) is exposed, said grasping area (5) juxtaposed the dispenser port (6).

* * * * *